US010337700B2

(12) United States Patent
Li

(10) Patent No.: US 10,337,700 B2
(45) Date of Patent: Jul. 2, 2019

(54) BOLT LOCKING STRUCTURE FOR WATERPROOF LED LAMP

(71) Applicant: Feng Li, Guangdong (CN)

(72) Inventor: Feng Li, Guangdong (CN)

( * ) Notice: Subject to any disclaimer, the term of this patent is extended or adjusted under 35 U.S.C. 154(b) by 0 days.

(21) Appl. No.: 15/310,791

(22) PCT Filed: Sep. 17, 2015

(86) PCT No.: PCT/CN2015/089841

§ 371 (c)(1),
(2) Date: Nov. 14, 2016

(87) PCT Pub. No.: WO2017/041319

PCT Pub. Date: Mar. 16, 2017

(65) Prior Publication Data

US 2018/0224090 A1 Aug. 9, 2018

(30) Foreign Application Priority Data

Sep. 9, 2015 (CN) ..... 2015 1 0571434

(51) Int. Cl.

| | |
|---|---|
| ***F21V 15/01*** | (2006.01) |
| ***F21V 31/00*** | (2006.01) |
| ***F21V 17/10*** | (2006.01) |
| *F21Y 115/10* | (2016.01) |

(52) U.S. Cl.

CPC ..... *F21V 15/01* (2013.01); *F21V 17/104* (2013.01); *F21V 31/00* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 6,707,678 | B2 * | 3/2004 | Kobayashi | H05K 5/0052 361/752 |
| 7,413,445 | B2 * | 8/2008 | Inagaki | B60R 16/0239 439/76.1 |
| 8,184,438 | B2 * | 5/2012 | Kaneko | H05K 7/20854 165/80.2 |
| 8,687,374 | B2 * | 4/2014 | Watanabe | H05K 5/0052 361/752 |
| 8,814,576 | B2 * | 8/2014 | Yoshida | H01R 13/2428 439/76.1 |

(Continued)

*Primary Examiner* — Elmito Breval

(57) ABSTRACT

A bolt locking structure for a waterproof LED lamp contains: a first casing and a second casing. The first casing includes multiple first protrusions and multiple first recesses which are arranged on each of four peripheral walls thereof respectively. The second casing includes multiple second protrusions and multiple second recesses which are arranged on each of four peripheral walls thereof respectively. The multiple first protrusions retain with the multiple second recesses, and the multiple first recesses retain with the multiple second protrusions. Multiple through holes are coaxial and form on each peripheral wall of each of the first casing and the second casing respectively, wherein each of the multiple through holes passes through each of the multiple first protrusions and the multiple second protrusions, such that each of multiple connection bolts inserts into the multiple through holes, thus locking the first casing and the second casing together.

7 Claims, 1 Drawing Sheet

(56) References Cited

U.S. PATENT DOCUMENTS

| | | | | |
|---|---|---|---|---|
| 8,929,079 | B2 * | 1/2015 | Watanabe | H05K 7/20854 165/104.33 |
| 9,276,350 | B1 * | 3/2016 | Wang | H01R 13/5202 |
| 9,293,870 | B1 * | 3/2016 | Koczwara | H05K 5/0069 |
| 9,888,588 | B2 * | 2/2018 | Esterbauer | G02F 1/133308 |
| 2003/0147204 | A1 * | 8/2003 | Koike | H05K 5/0043 361/600 |
| 2003/0147217 | A1 * | 8/2003 | Koike | H05K 5/0043 361/715 |

* cited by examiner

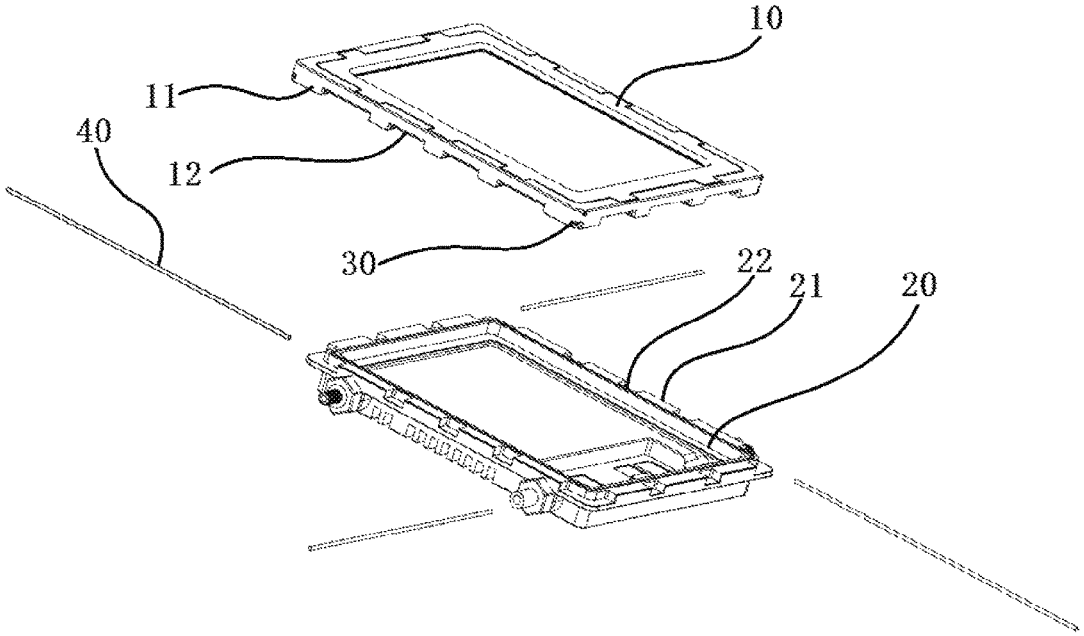
10
11
40
12
30
22
21
20

BOLT LOCKING STRUCTURE FOR WATERPROOF LED LAMP

FIELD OF THE INVENTION

The present invention relates to a bolt locking structure, and more particularly to the bolt locking structure for a waterproof LED lamp.

BACKGROUND OF THE INVENTION

A conventional locking structure for a waterproof LED lamp contains multiple threaded orifices formed on a casing, a plurality of screws or screw bolts, and multiple nuts, such that the waterproof LED lamp is fixed by screwing the multiple threaded orifices, the plurality of screws or screw bolts, and the multiple nuts together.

However, water flows into the waterproof LED lamp easily at high water pressure.

The present invention has arisen to mitigate and/or obviate the afore-described disadvantages.

SUMMARY OF THE INVENTION

The primary objective of the present invention is to provide a bolt locking structure for a waterproof LED lamp which locks the first casing and the second casing securely.

Further objective of the present invention is to provide a bolt locking structure for a waterproof LED lamp in which the two ends of said each connection bolt are machined at 45 degree chamfer so as to avoid damage, after the first casing and the second casing are locked.

Another objective of the present invention is to provide a bolt locking structure for a waterproof LED lamp which is simplified and is not broken easily.

To obtain above-mentioned objectives, a bolt locking structure for a waterproof LED lamp provided by the present invention contains: a first casing and a second casing, wherein the first casing and the second casing are in a rectangle shape.

The first casing includes multiple first protrusions and multiple first recesses which are arranged on each of four peripheral walls thereof respectively, wherein any two adjacent of the multiple first protrusions are separated by each of the multiple first recesses, and any two adjacent of the multiple first recesses are separated by each of the multiple first protrusions.

The second casing includes multiple second protrusions and multiple second recesses which are arranged on each of four peripheral walls thereof respectively, wherein any two adjacent of the multiple second protrusions are separated by each of the multiple second recesses, and any two adjacent of the multiple second recesses are separated by each of the multiple second protrusions.

The multiple first protrusions of the first casing retain with the multiple second recesses of the second casing, and the multiple first recesses of the first casing retain with the multiple second protrusions of the second casing.

Multiple through holes are coaxial and form on each peripheral wall of each of the first casing and the second casing respectively, wherein each of the multiple through holes passes through each of the multiple first protrusions and the multiple second protrusions, such that each of multiple connection bolts inserts into the multiple through holes, thus locking the first casing and the second casing together.

Preferably, a width of said each first protrusion is less than that of said each first recess, wherein each of four L-shaped projections is defined on each of four corners of the first casing; a width of said each second recess is less than that of said each second protrusion, wherein each of four L-shaped trenches is defined on each of four corners of the second casing.

Preferably, when the first casing and the second casing retain together, the multiple through holes on said each peripheral wall of the first casing are coaxial with those on said each peripheral wall of the second casing.

Preferably, said each L-shaped projection of the first casing has an L-shaped orifice defined on a corner thereof.

Preferably, two ends of each of the multiple through holes are machined at 45 degree chamfer.

Preferably, among the multiple through holes and said each connection bolt is arranged a silicone rubber.

Preferably, a diameter of said each connection bolt is 2.5 mm, and an error between said each connection bolt and said each through hole is 0.1 mm.

A method of assembling the bolt locking structure contains steps of:

Retaining multiple first protrusions of a first casing with multiple second recesses of a second casing, and retaining multiple first recesses of the first casing with multiple second protrusions of the second casing;

Applying liquid silicone rubber on each of four connection bolt, and inserting said each connection bolt through multiple through holes on each of four peripheral walls of each of the first casing and the second casing respectively; and Solidifying the liquid silicone rubber so that said each connection bolt is adhered in the multiple through holes.

The first casing and the second casing retain together, the multiple through holes on said each peripheral wall of the first casing are coaxial with those on said each peripheral wall of the second casing.

After the liquid silicone rubber solidifies, another liquid silicone rubber is applied on two ends of said each connection bolt, and the first casing and the second casing are fixed, after said another liquid silicone rubber solidifies.

BRIEF DESCRIPTION OF THE DRAWINGS

FIG. 1 is a perspective view showing the exploded components of a bolt locking structure for a waterproof LED lamp according to a preferred embodiment of the present invention.

DETAILED DESCRIPTION OF THE PREFERRED EMBODIMENTS

With reference to FIG. 2, a bolt locking structure for a waterproof LED lamp according to a preferred embodiment of the present invention comprises: a first casing 10 and a second casing 20, wherein each of the first casing 10 and the second casing 20 is in a rectangle shape.

The first casing 10 includes multiple first protrusions 11 and multiple first recesses 12 which are arranged on each of four peripheral walls thereof respectively, wherein any two adjacent of the multiple first protrusions 11 are separated by each of the multiple first recesses 12, and any two adjacent of the multiple first recesses 12 are separated by each of the multiple first protrusions 11. The second casing 20 includes multiple second protrusions 21 and multiple second recesses 22 which are arranged on each of four peripheral walls thereof respectively, wherein any two adjacent of the multiple second protrusions 21 are separated by each of the multiple second recesses 22, and any two adjacent of the multiple second recesses 22 are separated by each of the multiple second protrusions 21. The multiple first protrusions 11 of the first casing 10 retain with the multiple second recesses 22 of the second casing 20, and the multiple first recesses 12 of the first casing 10 retain with the multiple second protrusions 21 of the second casing 20.

Multiple through holes 30 are coaxial and form on each peripheral wall of each of the first casing 10 and the second casing 20 respectively, wherein each of the multiple through holes 30 passes through each of the multiple first protrusions 11 and the multiple second protrusions 21, such that each of multiple connection bolts 40 inserts into the multiple through holes 30, thus locking the first casing 10 and the second casing 20 together. In this embodiment, four connection bolts 40 correspond to the four peripheral walls of each of the first casing 10 and the second casing 20, respectively.

When the multiple first protrusions 11 of the first casing 10 retain with the multiple second recesses 22 of the second casing 20, and the multiple first recesses 12 of the first casing 10 retain with the multiple second protrusions 21 of the second casing 20, said each connection bolt 40 inserts through the multiple through holes 30, thus locking the first casing 10 and the second casing 20 together.

A width of said each first protrusion 11 is less than that of said each first recess 12, wherein each of four L-shaped projections is defined on each of four corners of the first casing 10.

A width of said each second recess 22 is less than that of said each second protrusion 21, wherein each of four L-shaped trenches is defined on each of four corners of the second casing 20.

When the first casing 10 and the second casing 20 retain together, the multiple through holes 30 on said each peripheral wall of the first casing 10 are coaxial with those on said each peripheral wall of the second casing 20.

Said each L-shaped projection of the first casing 10 has an L-shaped orifice defined on a corner thereof.

Two ends of each of the multiple through holes 30 and the L-shaped orifice are machined at 45 degree chamfer.

Among the multiple through holes 30 and said each connection bolt 40 is arranged a silicone rubber.

A diameter of said each connection bolt 40 is 2.5 mm, and an error between said each connection bolt 40 and said each through hole 30 is 0.1 mm.

In assembly, the multiple first protrusions 11 of the first casing 10 are retained with the multiple second recesses 22 of the second casing 20, and the multiple first recesses 12 of the first casing 10 are retained with the multiple second protrusions 21 of the second casing 20, such that the multiple through holes 30 are coaxial. Thereafter, liquid silicone rubber is applied on said each connection bolt 40, and said each connection bolt 40 is inserted through the multiple through holes 30. After the liquid silicone rubber solidifies, said each connection bolt 40 is adhered in the multiple through holes 30. In addition, another liquid silicone rubber is applied on two ends of said each connection bolt 40, and the first casing 10 and the second casing 20 are fixed, after said another liquid silicone rubber solidifies.

Preferably, each of a first connection surface of the first casing 10 and a second connection surface of the second casing 20 has a silicone rubber film injection molded thereon, wherein the first connection surface of the first casing 10 faces the second connection surface of the second casing 20, a thickness of the silicone rubber film is 0.2 mm, and the silicone rubber film matingly contacts with the each of the first connection surface of the first casing 10 and the second connection surface of the second casing 20. Preferably, the silicone rubber film contacts with said each first protrusion 11, said each first recess 12, said each second protrusion 21, and said each second recess 22.

Thereby, when the first casing and the second casing retain together, said each first protrusion retains with said each second recess and said each first recess retains with said each second protrusion by using the silicone rubber film, and said each connection bolt locks the first casing and the second casing securely.

Preferably, the two ends of said each connection bolt are machined at 45 degree chamfer so as to avoid damage, after the first casing and the second casing are locked, hence the bolt locking structure is simplified and is not broken easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A locking structure for a waterproof LED lamp comprising:

a first casing, being in a rectangular shape, having four first peripheral walls and multiple first protrusions and multiple first recesses which are coplanarly formed on each of the four first peripheral walls, any two adjacent of the multiple first protrusions being separated by one of the multiple first recesses, and any two adjacent of the multiple first recesses being separated by one of the multiple first protrusions;

a second casing, being in a rectangular shape corresponding to the first casing, having four second peripheral walls and multiple second protrusions and multiple second recesses which are coplanarly formed on each of the four second peripheral walls, any two adjacent of the multiple second protrusions being separated by one of the multiple second recesses, and any two adjacent of the multiple second recesses being separated by one of the multiple second protrusions; and multiple connecting rods;

wherein each of the multiple first protrusions of the first casing is embedded into one of the multiple second recesses of the second casing, each of the multiple first recesses of the first casing is embedded by one of the multiple second protrusions of the second casing, and all of the first and second protrusions and the first and second recesses which engage with each other are coplanar; and wherein multiple through holes are coaxially formed in each of the first and second protrusions which are adjacent, and each of the connecting rods is inserted into the multiple through holes which align with each other to fasten the first casing and the second casing together.

2. The locking structure as claimed in claim 1, wherein a width of said each first protrusion is less than that of said each first recess, wherein each of four L-shaped projections is defined on each of four corners of the first casing; a width of said each second recess is less than that of said each second protrusion, wherein each of four L-shaped trenches is defined on each of four corners of the second casing.

3. The locking structure as claimed in claim 1, wherein when the first casing and the second casing retain together, the multiple through holes on each first peripheral wall of the first casing are coaxial with those on each second peripheral wall of the second casing.

4. The locking structure as claimed in claim 1, wherein said each L-shaped projection of the first casing has an L-shaped orifice defined on a corner thereof.

5. The locking structure as claimed in claim 1, wherein two ends of each of the multiple through holes are machined at 45 degree chamfer.

6. The locking structure as claimed in claim 1, further comprising silicone rubber filled between each of the multiple through holes and each connecting rod.

7. The locking structure as claimed in claim 1, wherein a diameter of each connecting rod is 2.5 mm, and an error between each connecting rod and said each through hole is 0.1 mm.

* * * * *